US008376419B2

(12) United States Patent
Konomoto et al.

(10) Patent No.: US 8,376,419 B2
(45) Date of Patent: Feb. 19, 2013

(54) VEHICLE DOOR LATCH DEVICE

(75) Inventors: Norio Konomoto, Nagoya (JP); Akira Muramatsu, Chiryu (JP); Kosuke Tsukamoto, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 436 days.

(21) Appl. No.: 12/670,074

(22) PCT Filed: Sep. 29, 2008

(86) PCT No.: PCT/JP2008/067650
§ 371 (c)(1),
(2), (4) Date: Jan. 21, 2010

(87) PCT Pub. No.: WO2009/047996
PCT Pub. Date: Apr. 16, 2009

(65) Prior Publication Data

US 2010/0194121 A1 Aug. 5, 2010

(30) Foreign Application Priority Data

Oct. 9, 2007 (JP) ..... 2007-263188

(51) Int. Cl.
*E05C 3/06* (2006.01)
*E05C 3/16* (2006.01)

(52) U.S. Cl. ..... 292/216; 292/DIG. 61

(58) Field of Classification Search ..... 292/201, 292/216, DIG. 61
See application file for complete search history.

(56) References Cited

U.S. PATENT DOCUMENTS 3,504,511 A * 4/1970 Allen ..... 70/241
4,172,768 A * 10/1979 Cerdan ..... 292/216
4,334,704 A * 6/1982 Yamada ..... 292/216
(Continued)

FOREIGN PATENT DOCUMENTS

CN 1603561 A 4/2005
CN 1609397 A 4/2005
(Continued)

OTHER PUBLICATIONS

*English language translation of International Preliminary Report on Patentability issued May 11, 2010 by The International Bureau of WIPO in International Application No. PCT/JP2008/067650.

(Continued)

*Primary Examiner* — Carlos Lugo
(74) *Attorney, Agent, or Firm* — Buchanan Ingersoll & Rooney

(57) ABSTRACT

A vehicle door latch device, comprising: a housing provided in a vehicle door; a latch rotatably supported by the housing, wherein a striker provided in the vehicle body can be fitted to the latch; a pawl having a shaft portion rotatably supported by the housing, wherein the pawl is engageable with the latch to restrict rotation of the latch; a helical torsion spring having a helical portion through which the shaft portion is passed, first and second engaging legs extending radially outward in relation to the helical portion, wherein the first engaging leg is engaged with the pawl, and the second engaging leg is engaged with the housing, the helical torsion spring always urging the pawl to rotate to an engagement position where the pawl can be engaged with the latch; and a projecting wall formed in the housing, the projecting wall contacting an outer circumferential surface of the helical portion.

10 Claims, 5 Drawing Sheets

U.S. PATENT DOCUMENTS

| | | | | |
|---|---|---|---|---|
| 4,653,784 | A * | 3/1987 | Lee | 292/71 |
| 4,936,611 | A * | 6/1990 | Palvolgyi | 292/28 |
| 5,048,879 | A | 9/1991 | Fukumoto et al. | |
| 6,485,071 | B2 * | 11/2002 | Schwaiger | 292/216 |
| 6,547,291 | B1 * | 4/2003 | Schwaiger | 292/216 |
| 7,210,713 | B2 | 5/2007 | Yoshida et al. | |
| 7,543,861 | B2 | 6/2009 | Dupont et al. | |
| 2005/0073156 | A1 | 4/2005 | Oh | |
| 2011/0012376 | A1 * | 1/2011 | Hunt et al. | 292/216 |
| 2011/0260475 | A1 * | 10/2011 | Spurr et al. | 292/195 |

FOREIGN PATENT DOCUMENTS

| | | | |
|---|---|---|---|
| CN | 1754033 | A | 3/2006 |
| JP | 63-46566 | A | 3/1988 |
| JP | 63-46566 | U | 3/1988 |
| JP | 3-055373 | A | 3/1991 |
| JP | 2519638 | Y2 | 12/1996 |
| JP | 2002-129809 | A | 5/2002 |
| JP | 2002-220960 | A | 8/2002 |
| JP | 2003-293638 | A | 10/2003 |

OTHER PUBLICATIONS

* International Search Report issued on Nov. 25, 2008 by the Japanese Patent Office as the International Searching Authority in International Application No. PCT/JP2008/067650.

Office Action issued in corresponding Chinese patent application No. 200880101228.2 on Sep. 10, 2012.

* cited by examiner

VEHICLE DOOR LATCH DEVICE

TECHNICAL FIELD

The present invention relates to a vehicle door latch device.

BACKGROUND ART

Conventionally, an example of a vehicle door latch device as described in Patent Document 1 is known. FIG. 6 is a diagram showing the structure and operation of a vehicle door latch device disclosed in Patent Document 1. The vehicle door latch device includes a latch 91, a pawl 92, and a helical torsion spring 94. The latch 91 is rotatably supported by a housing provided in a vehicle door and receives a striker 90 on the vehicle body. The pawl 92 is rotatably supported by the housing, and can be fitted to the latch 91 so as to limit the rotation of the latch 91. The helical torsion spring 94 always urges the pawl 92 to rotate in a direction to cause the pawl 92 to engage with the latch 91. The housing has a stopper 93, and the pawl 92 is engageable with the pawl 92.

The pawl 92 includes a block-like main body portion 92*a* and a shaft portion 92*b* extending from a center portion of the main body portion 92*a*. The shaft portion 92*b* is passed through a shaft receiving hole 95 formed in the housing, so that the pawl 92 is rotatably supported by the housing.

The helical torsion spring 94 includes a helical portion 94*a*, and first and second engaging legs 94*b*, 94*c*, which extend radially outward relative to the helical portion 94*a*. The shaft portion 92*b* is passed through the helical portion 94*a* at a position where the shaft portion 92*b* does not interfere with the housing. The first engaging leg 94*b* is engaged with the pawl 92, and the second engaging leg 94*c* is engaged with an engaging portion 96 provided in the housing.

In this manner, the helical portion 94*a* of the helical torsion spring 94 is mounted about the shaft portion 92*b* of the pawl 92 so as to be coaxial with the shaft portion 92*b*, so that the operation reliability of the pawl 92 is improved.

In the vehicle door latch device disclosed in Patent Document 1, when a vehicle door is in an openable state (hereinafter, referred to as "initial state") and the striker 90 is not meshed with the latch 91, the main body portion 92*a* of the pawl 92 contacts the stopper 93 at a location marked by sign ○. At this time, the main body portion 92*a* receives, through the first engaging leg 94*b* of the helical torsion spring 94, a force (indicated by thick arrows) that rotates the pawl 92 counterclockwise as viewed in the drawings about a portion that contacts the stopper 93 as a fulcrum. The urging force urges the shaft portion 92*b* of the pawl 92 toward the latch 91, thereby causing the shaft portion 92*b* to contact the inner circumferential surface of the shaft receiving hole 95. At this time, the shaft portion 92*b* receives an urging force (indicated by thin arrows), which is a reactive force against the above described urging force, through the helical portion 94*a*. In this state, as shown in the left lower part of FIG. 6 in an exaggerated manner, the pawl 92 is arranged at an eccentric position in the shaft receiving hole 95 such that the clearance C between the shaft portion 92*b* and the inner circumferential surface of the shaft receiving hole 95 is zero at the top, and the clearance C is greater at the bottom.

When the vehicle door is manipulated to be closed, rotation of the latch 91 accompanying the entry of the striker 90 presses the pawl 92 against the latch 91, so that the pawl 92 is rotated clockwise while acting against the urging force of the helical torsion spring 94. The part of the pawl 92 that contacts the latch 91 is indicated by the sign ○. At this time, the main body portion 92*a* of the pawl 92 is pressed downward by the latch 91 at the contact position. Also, the urging force (indicated by thin arrows) acting on the shaft portion 92*b* through the helical portion 94*a* is greater than the initial state, and the urging force presses the pawl 92 downward. This arranges the pawl 92 eccentrically in the shaft receiving hole 95, such that the clearance C between the shaft portion 92*b* and the inner circumferential surface of the shaft receiving hole 95 is greater at the top.

Then, when the pawl 92 is released from the latch 91 immediately after a half-meshed state is achieved, where the latch 91 draws in the striker 90 halfway, the pawl 92 is, as in the initial state, arranged at an eccentric position in the shaft receiving hole 95 such that the clearance C between the shaft portion 92*b* and the inner circumferential surface of the shaft receiving hole 95 is zero at the top, and the clearance C is greater at the bottom.

When the pawl 92 returns to the position of the initial state, the shaft portion 92*b*, which moves in the shaft receiving hole 95, hits the inner circumferential surface of the shaft receiving hole 95 and produces unnatural hammering noise, which disturbs the user in some cases. Specifically, when the vehicle door is manipulated to be closed, cheap high pitched sound has been observed to be mixed in deep sound, which is normally produced when the vehicle door is closed.

Patent Document 2 discloses one example of known vehicle door latch devices that reduce such hammering noise. In this vehicle door latch device, the shaft portion of pawl is rotatably supported by a cylindrical projecting wall formed on the housing, and the helical portion of the helical torsion spring is held about the projecting wall. In this configuration, since the urging force of the helical portion does not act on the shaft portion, hammering noise due to movement of the shaft portion as described above is not produced. However, to provide the cylindrical projecting wall between the shaft portion and the helical portion, the helical portion needs have a large diameter. This inevitably causes another problem, namely, an increased size of the entire device.

Patent Document 1: Japanese Laid-Open Patent Publication No. 2002-129809

Patent Document 2: Japanese Registered Utility Model No. 2519638 (FIG. 3)

SUMMARY

According to an aspect of the present invention, a vehicle door latch device including a housing, a latch, a pawl, a helical torsion spring, and a projecting wall is provided. The housing is structured to be provided in a vehicle door. The latch rotatably is supported by the housing. A striker provided in the vehicle body can be fitted to the latch. The pawl has a shaft portion rotatably supported by the housing. The pawl is engageable with the latch to restrict rotation of the latch. The helical torsion spring has a helical portion through which the shaft portion is passed, a first engaging leg extending radially outward in relation to the helical portion, and a second engaging leg extending radially outward in relation to the helical portion. The first engaging leg is engaged with the pawl, and the second engaging leg is engaged with the housing. The helical torsion spring always urges the pawl to rotate to an engagement position where the pawl can be engaged with the latch. The projecting wall is formed in the housing and contacts an outer circumferential surface of the helical portion.

DETAILED DESCRIPTION OF THE PREFERRED EMBODIMENTS

Figure 1:
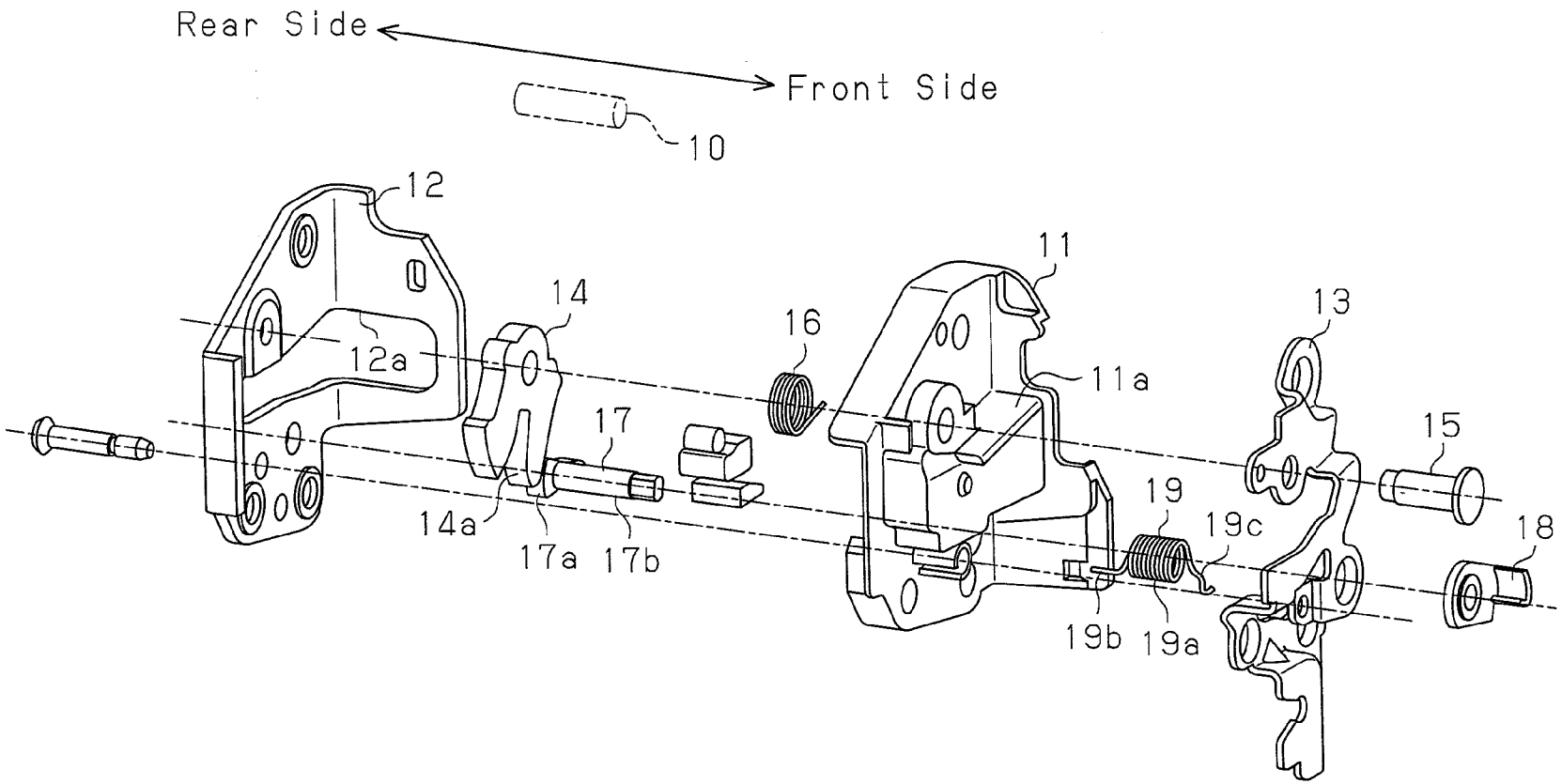
FIG. 1 is an exploded perspective view illustrating a vehicle door latch device according to first embodiment of the present invention.
Figure 2:
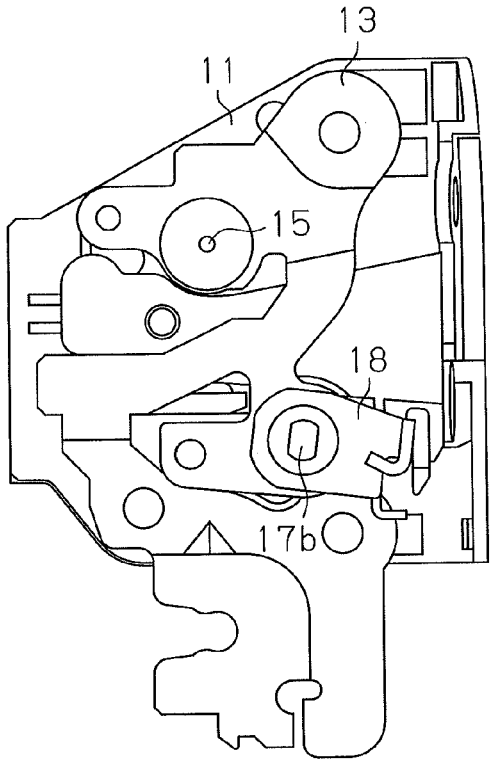
FIG. 2 is an elevational view showing the vehicle door latch device of FIG. 1, as seen from the front of the vehicle.
Figure 3:
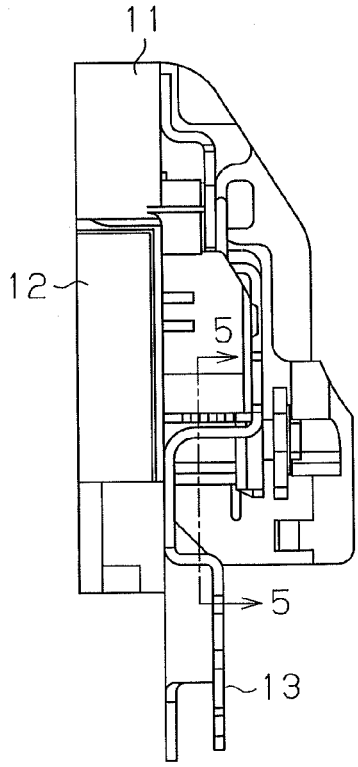
FIG. 3 is an elevational view of the vehicle door latch device of FIG. 1, as seen from the outside of the vehicle toward the vehicle door.

Hereinafter, a preferred embodiment of the present invention will be described with reference to drawings.

As shown in FIGS. 1 to 5, a vehicle door latch device includes a body 11, which is, for example, made of resin, a metal base plate 12, and a metal sub-base plate 13. The base plate 12 and the sub-base plate 13 sandwich the body 11 and form an accommodation space. The body 11, the base plate 12, and the sub-base plate 13 are integrally assembled to form a housing attached to a vehicle door. To guide entry (relative entry) a striker 10 provided in the vehicle body (refer to FIG. 1), the body 11 has a guide portion 11*a* having a channel-like cross section, and the base plate 12 has a rectangular guide hole 12*a*.

A latch 14 is accommodated between the body 11 and the base plate 12. The distal end of a support pin 15 is passed through the sub-base plate 13, the body 11, the latch 14, and the base plate 12 in this order, and is retained by the base plate 12. The latch 14 is supported to be rotatable about the support pin 15. The latch 14 is formed like scissors and has an engaging groove 14*a*, which is meshed with the striker 10 by drawing in the striker 10 when receiving the striker 10.

A torsion coil spring (urging member) 16, which is arranged between the body 11 and the latch 14, has a coil portion, a first end, and a second end. The coil portion is arranged coaxially about the support pin 15, and the first and second ends are engaged with the latch 14 and the body 11 (housing), respectively. The torsion coil spring 16 applies a predetermined force to the latch 14 so as to limit rotation of the latch 14. When the latch 14 rotates, the latch 14 is urged by the force and is rotated to return to the original position. Therefore, when the latch 14 is released from the surrounding members, for example, when the vehicle door is open, the torsion coil spring 16 always urges the latch 14 to rotate such that the engaging groove 14*a* faces the direction of entry of the striker 10 (see FIG. 5). At this time, the latch 14 is held such that the opening of the engaging groove 14*a* is oriented in the same direction as the openings of the guide portion 11*a* and the guide hole 12*a*.

A pawl 17 is provided between the base plate 12 and the sub-base plate 13. The pawl 17 includes a block-like main body portion 17*a* and a shaft portion 17*b*. The main body portion 17*a* is accommodated between the body 11 and the base plate 12 and below the latch 14, and the shaft portion 17*b* extends from a center of the main body portion 17*a*. The distal end of the shaft portion 17*b* is passed through the body 11, the sub-base plate 13, and a center of a lift lever 18 in this order, and is fitted and retained in the center of the lift lever 18. When operating force is transmitted to the lift lever 18, for example, from the door handle of the vehicle door through an unillustrated actuation mechanism, the lift lever 18 rotates integrally with the pawl 17.

The shaft portion 17*b* is passed through the base plate 12, so that the pawl 17 is rotatably supported by the base plate 12 (housing). In this manner, the pawl 17, which is rotatably supported by the housing, engages the latch 14 with the main body portion 17*a*, thereby restricting rotation of the latch 14. Rotation of the latch 14 is restricted when the latch 14 is meshed with the striker 10, for example, when the vehicle door is closed. When the restriction of the rotation by the pawl 17 is cancelled, the latch 14, which is meshed with the striker 10, is urged by the torsion coil spring 16 and is rotated to return to a position where the engaging groove 14*a* faces in the direction of entry of the striker 10, that is, to a position where the striker 10 can exit the engaging groove 14*a*.

Figure 4:
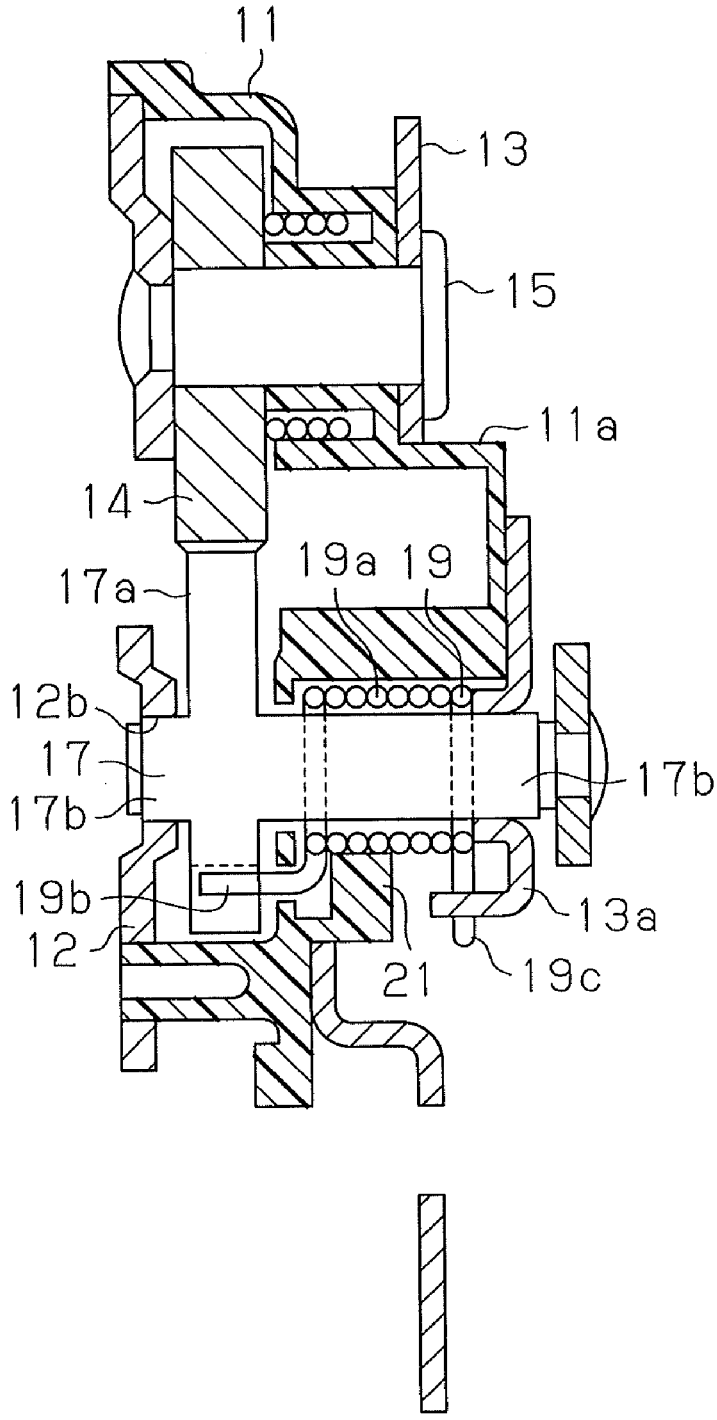
FIG. 4 is a cross-sectional view of the vehicle door latch device of FIG. 1, as seen from the outside of the vehicle toward the vehicle door.

As shown in FIG. 4, the base plate 12 has a circular shaft receiving hole 12*b*, which serves as a support hole. The shaft portion 17*b* of the pawl 17 is rotatably supported by the shaft receiving hole 12*b* (the base plate 12) so that its outer circumferential surface slides on the inner circumferential surface of the shaft receiving hole 12*b*. A clearance C (refer to FIG. 5) exists between the outer circumferential surface of the shaft portion 17*b* and the inner circumferential surface of the shaft receiving hole 12*b*. The clearance C allows the shaft portion 17*b* to rotate relative to the shaft receiving hole 12*b*. In addition to this, a similar shaft receiving hole may be formed in the sub-base plate 13.

A helical torsion spring 19, which is a torsion coil spring, is located between the body 11 and the sub-base plate 13. The helical torsion spring 19 includes a helical portion (coil portion) 19*a*, through which the shaft portion 17*b* of the pawl 17 is passed. The helical portion 19*a* is located in a space formed between the body 11 and the sub-base plate 13 and below the guide portion 11*a*.

Figure 5:
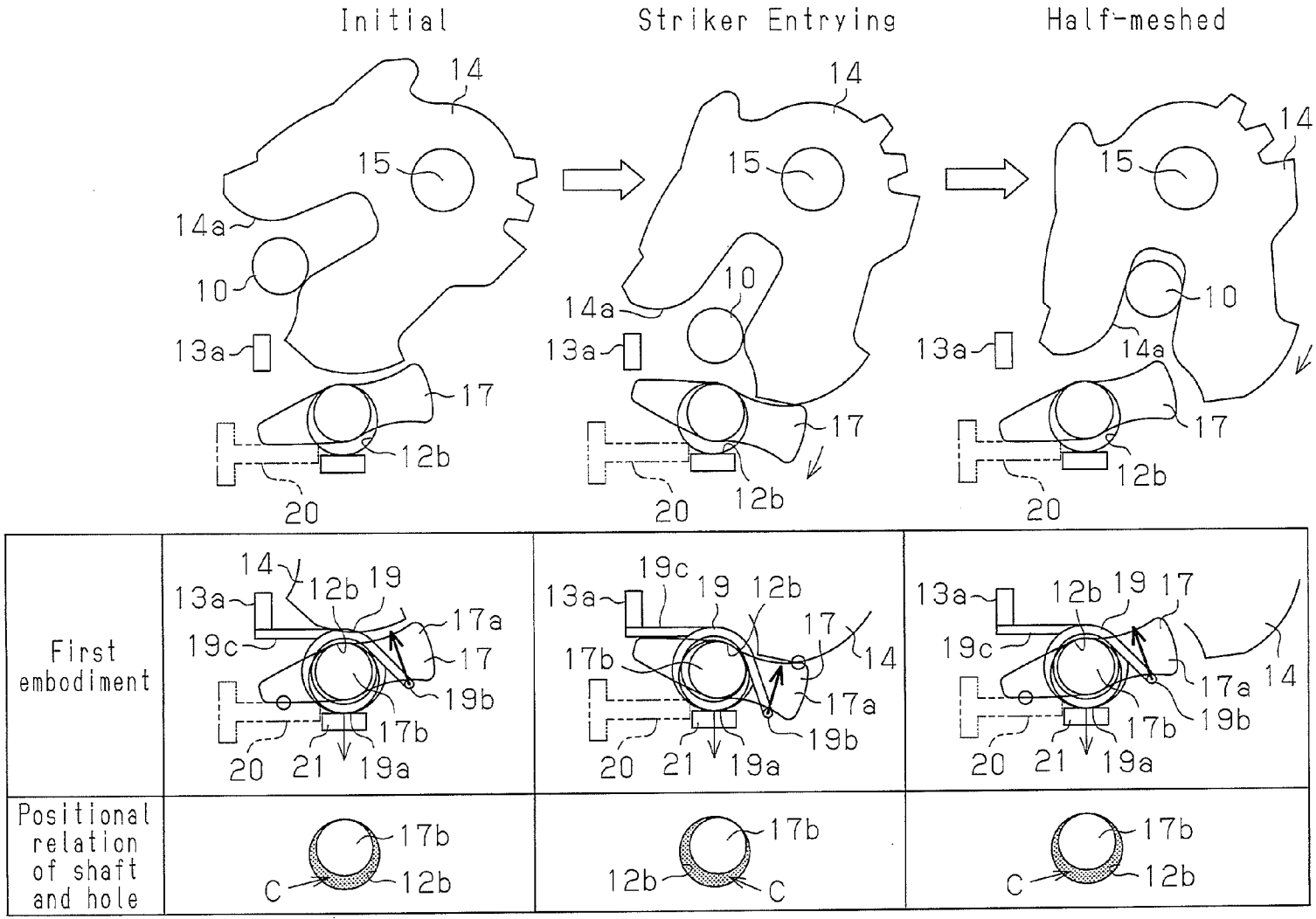
FIG. 5 is a diagram showing an operation of the vehicle door latch device of FIG. 1, as seen at a cross-section taken along line 5-5 of FIG. 3.
Figure 6:
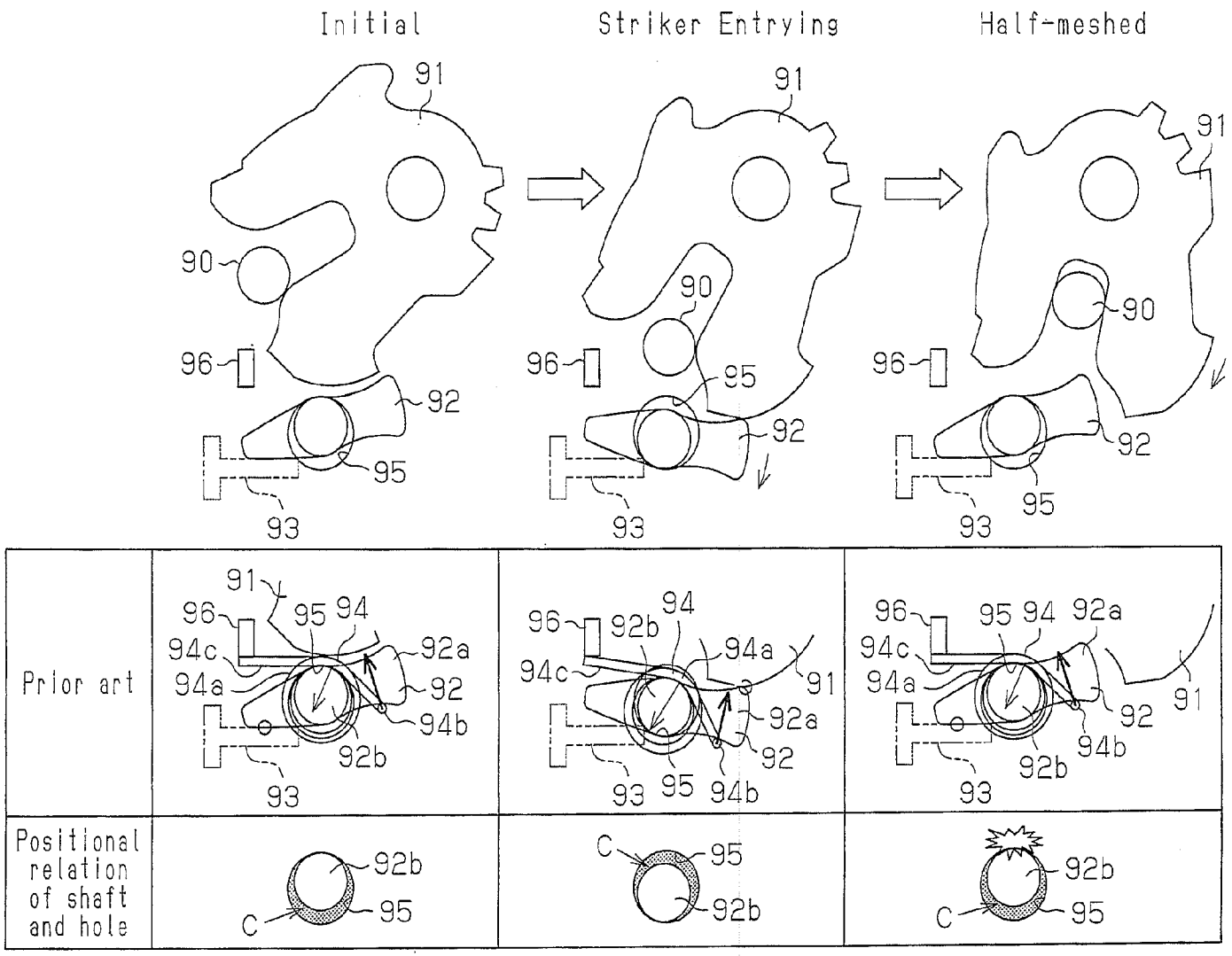
Fig.6 Prior Art
FIG. 6 is a diagram showing an operation of a prior art vehicle door latch device.

The helical torsion spring 19 includes a first engaging leg 19*b* and a second engaging leg 19*c*. The first engaging leg 19*b* extends radially outward in relation to the helical portion 19*a* to be passed through the body 11 and engaged with the main body portion 17*a*. The second engaging leg 19*c* also extends radially outward in relation to the helical portion 19*a* to be engaged with an engaging portion 13*a* of the sub-base plate 13. The first and second engaging legs 19*b*, 19*c* extend in opposite directions from the helical portion 19*a*. As shown in FIG. 5, the helical torsion spring 19 always urges the main body portion 17*a* to rotate in the counterclockwise direction as viewed in the drawing, or in a direction to engage with the latch 14, so that the main body portion 17*a* is engaged with a stopper 20 provided on the body 11. The pawl 17 can be engaged with the latch 14 by causing the main body portion 17*a* to contact the latch 14 meshed with the striker 10.

As shown in FIGS. 4 and 5, the body 11 has a projecting wall 21 located below the helical portion 19*a* to be pressed against the outer circumferential surface of the helical portion 19*a*. The projecting wall 21 projects in a direction opposite to the base plate 12. The projecting wall 21 extends substantially parallel with the shaft portion 17*b*. When the helical portion 19*a* is twisted and its diameter is reduced, an urging force is applied to the pawl 17 through the first engaging leg 19*b*. In this state, the projecting wall 21 receives an urging force that acts on the helical portion 19*a* as a reactive force against the force applied to the pawl 17.

The operation of the vehicle door latch device will now be described.

As shown in FIG. 5, when a vehicle door is in an openable state (hereinafter, referred to as "initial state") and the striker 10 is not meshed with the latch 14, the main body portion 17*a* of the pawl 17 contacts the stopper 20 at a location marked by sign ○. At this time, the main body portion 17*a* receives, through the first engaging leg 19*b* of the helical torsion spring 19, a force (indicated by thick arrows) that rotates the pawl 17 counterclockwise as viewed in the drawings about a portion that contacts the stopper 20 as a fulcrum. The urging force urges the shaft portion 17*b* of the pawl 17 toward the latch 14, thereby causing the shaft portion 17*b* to contact the inner circumferential surface of the shaft receiving hole 12*b*. At this time, the projecting wall 21 receives an urging force (indicated by thin arrows), which is a reactive force against the above described urging force, through the helical portion 19*a*. That is, the shaft portion 17*b* of the pawl 17 does not receive any urging force through the helical portion 19*a*. Therefore, as shown in the left lower part of FIG. 5 in an exaggerated manner, the pawl 17 is arranged at an eccentric position in the shaft receiving hole 12*b* such that the clearance C between the shaft portion 17*b* and the inner circumferential surface of the shaft receiving hole 12*b* is zero at the top, and the clearance C is greater at the bottom.

When the vehicle door is manipulated to be closed, rotation of the latch 14 accompanying the entry of the striker 10 presses the pawl 17 against the latch 14, so that the pawl 17 is rotated clockwise while acting against the urging force of the helical torsion spring 19. The part of the pawl 17 that contacts the latch 14 is indicated by the sign ○. At this time, the main body portion 17*a* of the pawl 17 is pressed downward by the latch 14 at the contact position. At this time, although the urging force acting on the projecting wall 21 through the helical portion 19*a* (indicated by thin arrows in the drawing) is greater than that in the initial state, the shaft portion 17*b* of the pawl 17 naturally receives no urging force through the helical portion 19*a*. Thus, even though the shaft portion 17*b* is slightly moved within the shaft receiving hole 12*b*, the pawl 17 is at such a position in the shaft receiving hole 12*b* that the clearance C between the shaft portion 17*b* and the inner circumferential surface of the shaft receiving hole 12*b* is still zero at the top and is greater than zero at the bottom. That is, when the pawl 17 is being rotated against the urging force of the helical torsion spring 19, the projecting wall 21 is held in contact with the outer circumferential of the helical portion 19*a*. In this manner, the projecting wall 21 maintains the contacting state of the outer circumferential surface of the shaft portion 17*b* and the inner circumferential surface of the shaft receiving hole 12*b* and the state of the clearance C substantially to the same as the initial state. That is, at a side opposite to the contacting parts of the projecting wall 21 and the helical portion 19*a* with respect to the shaft portion 17*b*, the projecting wall 21 maintains a state where the outer circumferential surface of the shaft portion 17*b* and the inner circumferential surface of the shaft receiving hole 12*b* contact each other.

Then, the pawl 17 is released from the latch 14 again immediately after the latch 14 draws in the striker 10 halfway, and the latch 14 is in a half-meshed state, the pawl 17 returns to the initial state. At this time, even though the shaft portion 17*b* is slightly moved within the shaft receiving hole 12*b*, the pawl 17 is at such a position in the shaft receiving hole 12*b* that the clearance C between the shaft portion 17*b* and the inner circumferential surface of the shaft receiving hole 12*b* is still zero at the top and is greater than zero at the bottom.

Thereafter, the latch 14 is urged by the torsion coil spring 16 and acts to rotate to return to the original position. When returned to the initial state, the pawl 17 causes the latch 14 to engage with the main body portion 17*a*, so that the rotation of the latch 14 is restricted and the latch 14 is in the half-meshed state with the striker 10. The vehicle door is thus maintained half-closed.

That is, in the present embodiment, the movement of the shaft portion 17*b* within the shaft receiving hole 12*b* when the vehicle door is manipulated to be closed, that is, changes in the clearance C is small. Therefore, the shaft portion 17*b*, which moves within the shaft receiving hole 12*b*, is prevented from hitting the inner circumferential surface of the shaft receiving hole 12*b*. Unnatural hammering noise is thus reduced.

When the vehicle door is further manipulated from the half-closed state to the fully-closed state, operation similar to the above described operation prevents unnatural hammering noise from being produced.

For example, if operating force is transmitted to the lift lever 18 from the door handle as describe above when the vehicle door is in the fully-closed state, the lift lever 18 rotates integrally with the pawl 17, thereby cancelling the restriction of the rotation of the latch 14 by the pawl 17. Accordingly, the latch 14, which is meshed with the striker 10, is urged by the torsion coil spring 16 and is rotated to return to a position where the engaging groove 14*a* faces in the direction of entry of the striker 10, that is, to a position where the striker 10 can exit the engaging groove 14*a*. The vehicle door is then in the openable state.

The above illustrated embodiment has the following advantages.

(1) In the present embodiment, the body 11 (housing) has the projecting wall 21. When the first engaging leg 19*b* applies an urging force to the pawl 17, the projecting wall 21 contacts the outer circumferential surface of the helical portion 19*a* and receives an urging force that acts on the helical portion 19*a* as a reactive force against the urging force applied to the pawl 17. Therefore, in a case where the vehicle door is manipulated to be closed, when the pawl 17 is rotated against the urging force of the helical torsion spring 19 by rotation of the latch 14 accompanying the entry of the striker 10 into the engaging groove 14*a*, the above described urging force acting on the helical portion 19*a* is received by the projecting wall 21. Therefore, the shaft portion 17*b* is prevented from moving within the shaft receiving hole 12*b*, and from hitting the inner circumferential surface of the shaft receiving hole 12*b* and producing unnatural hammering noise. Accordingly, the user is prevented from being disturbed by hammering noise.

The helical portion 19*a* is located inside the projecting wall 21 with respect to the radial direction of the shaft portion 17*b*. Therefore, the size of the helical torsion spring 19 can be reduced, and the size of the entire device can be reduced.

(2) In the present embodiment, the projecting wall 21, which contacts the outer circumferential wall of the helical portion 19*a*, is formed at a part of the lower potion of the shaft receiving hole 12*b*. Thus, when the pawl 17 is rotated, sliding resistance between the helical portion 19*a* and the projecting wall 21 is minimized, which prevents the required operating force from being unnecessarily increased.

(3) In the present embodiment, the helical torsion spring 19 (the helical portion 19*a*) is arranged about the shaft portion 17*b* of the pawl 17 to be coaxial with the shaft portion 17*b*. Thus, linear loading characteristics are obtained. This improves the operating feel of rotation of the pawl 17 (manipulation of the door handle), and the reliability of the operation of the pawl 17 is improved.

The above described embodiments may be modified as follows.

In the above embodiment, the projecting wall 21, which contacts the outer circumferential wall of the helical portion

19*a*, is located at a part of the lower portion of the shaft receiving hole 12*b*. However, the projecting wall 21 may be formed to cylindrically project so as to encompass the shaft receiving hole 12*b*.

In the above embodiment, as long as the clearance is maintained to a constant size between the outer circumferential surface of the shaft portion 17*b* and the inner circumferential surface of the shaft receiving hole 12*b*, the projecting wall 21 may be formed to contact any part of the helical portion 19*a* in any manner.

The invention claimed is:

1. A vehicle door latch device, comprising:

a housing structured to be provided in a vehicle door;

a latch rotatably supported by the housing, wherein a striker provided in the vehicle body can be fitted to the latch;

a pawl having a shaft portion rotatably supported by the housing, wherein the pawl is engageable with the latch to restrict rotation of the latch;

a helical torsion spring having a helical portion through which the shaft portion is passed, a first engaging leg extending radially outward in relation to the helical portion, and a second engaging leg extending radially outward in relation to the helical portion, wherein the first engaging leg is engaged with the pawl, and the second engaging leg is engaged with the housing, the helical torsion spring always urging the pawl to rotate to an engagement position where the pawl can be engaged with the latch; and a projecting wall formed in the housing, the projecting wall contacting an outer circumferential surface of the helical portion, wherein the housing has a support hole with an inner circumferential surface, wherein the pawl shaft portion has an outer circumferential surface smaller than the inner circumferential surface of the support hole so that the pawl slides and rotates in the support hole to allow latching and unlatching of the device, wherein a clearance is provided between the outer circumferential surface of the shaft portion and the inner circumferential surface of the support hole, the clearance allowing the shaft portion to rotate relative to the support hole, and wherein the projecting wall contacts the helical portion, so as to maintain the clearance to a constant size.

2. A vehicle door latch device, comprising:

a housing structured to be provided in a vehicle door;

a latch rotatably supported by the housing, wherein a striker provided in the vehicle body can be fitted to the latch;

a pawl having a shaft portion rotatably supported by the housing, wherein the pawl is engageable with the latch to restrict rotation of the latch;

a helical torsion spring having a helical portion through which the shaft portion is passed, a first engaging leg extending radially outward in relation to the helical portion, and a second engaging leg extending radially outward in relation to the helical portion, wherein the first engaging leg is engaged with the pawl, and the second engaging leg is engaged with the housing, the helical torsion spring always urging the pawl to rotate to an engagement position where the pawl can be engaged with the latch; and a projecting wall formed in the housing, the projecting wall contacting an outer circumferential surface of the helical portion, wherein the housing has a support hole with an inner circumferential surface, wherein the pawl shaft portion has an outer circumferential surface smaller than the inner circumferential surface of the support hole so that the pawl slides and rotates in the support hole to allow latching and unlatching of the device, wherein a clearance is provided between the outer circumferential surface of the shaft portion and the inner circumferential surface of the support hole, the clearance allowing the shaft portion to rotate relative to the support hole, and wherein, at a position opposite to the contacting part of the projecting wall and the helical portion with respect to the shaft portion, the projecting wall maintains a state where the outer circumferential surface of the shaft portion contacts the inner circumferential surface of the support hole.

3. The vehicle door latch device according to claim 1, wherein the first and second engaging legs extend in directions opposite to each other.

4. The vehicle door latch device according to claim 1, wherein, when the diameter of the helical portion is reduced so that the helical portion applies an urging force to the pawl through the first engaging leg, the projecting wall receives an urging force that acts on the helical portion as a reactive force against the force applied to the pawl.

5. The vehicle door latch device according to claim 1, wherein the housing includes a body and a base plate, which are assembled to each other to form an accommodation space for accommodating the latch and the pawl, wherein the support hole is formed in the base plate, and the shaft portion extending through the body, and wherein the projecting wall extends from the body in a direction opposite to the base plate and substantially parallel with the shaft portion.

6. The vehicle door latch device according to claim 1, wherein the latch has an engaging groove that can be meshed with the striker, wherein an urging member is provided that always urges the latch to rotate, thereby orienting the engaging groove in a direction of entry of the striker, wherein, when the vehicle door is manipulated to be closed, the latch is rotated as the striker enters the engaging groove, and the latch presses the pawl, so that the pawl is rotated against the urging force of the helical torsion spring, and wherein, after the striker is meshed with the engaging groove, the pawl is released from the pressing by the latch and is rotated by the urging force of the helical torsion spring to return to the engagement position, so that rotation of the latch is restricted in a state where the striker is meshed with the engaging groove.

7. The vehicle door latch device according to claim 2, wherein the first and second engaging legs extend in directions opposite to each other.

8. The vehicle door latch device according to claim 2, wherein, when the diameter of the helical portion is reduced so that the helical portion applies an urging force to the pawl through the first engaging leg, the projecting wall receives an urging force that acts on the helical portion as a reactive force against the force applied to the pawl.

9. The vehicle door latch device according to claim 2, wherein the housing includes a body and a base plate, which are assembled to each other to form an accommodation space for accommodating the latch and the pawl, wherein the support hole is formed in the base plate, and the shaft portion extending through the body, and wherein the projecting wall extends from the body in a direction opposite to the base plate and substantially parallel with the shaft portion.

10. The vehicle door latch device according to claim 2, wherein the latch has an engaging groove that can be meshed with the striker, wherein an urging member is provided that always urges the latch to rotate, thereby orienting the engaging groove in a direction of entry of the striker, wherein, when the vehicle door is manipulated to be closed, the latch is rotated as the striker enters the engaging groove, and the latch presses the pawl, so that the pawl is rotated against the urging force of the helical torsion spring, and wherein, after the striker is meshed with the engaging groove, the pawl is released from the pressing by the latch and is rotated by the urging force of the helical torsion spring to return to the engagement position, so that rotation of the latch is restricted in a state where the striker is meshed with the engaging groove.

* * * * *